US005934498A

United States Patent [19]

Jordan

[11] Patent Number: 5,934,498

[45] Date of Patent: Aug. 10, 1999

[54] CONVENIENCE EASY OPENING END WITH LARGE REMOVAL PANEL

[75] Inventor: Charles L. Jordan, New Kensington, Pa.

[73] Assignee: Aluminum Company of America, Pittsburgh, Pa.

[21] Appl. No.: 08/934,424

[22] Filed: Sep. 19, 1997

[51] Int. Cl.[6] ..... B65D 17/34

[52] U.S. Cl. ..... 220/270; 220/273

[58] Field of Search ..... 220/268, 270, 220/272, 273, 269; 413/12, 15–17, 67

[56] References Cited

U.S. PATENT DOCUMENTS

| | | | |
|---|---|---|---|
| 3,232,474 | 2/1966 | Dunn . | |
| 3,480,175 | 11/1969 | Khoury | 220/273 |
| 3,693,827 | 9/1972 | Baumeyer et al. . | |
| 3,724,709 | 4/1973 | Westphal . | |
| 3,768,692 | 10/1973 | Saunders . | |
| 3,773,210 | 11/1973 | Radtke . | |
| 4,043,479 | 8/1977 | Khoury . | |
| 4,196,823 | 4/1980 | Madden et al. . | |
| 4,548,333 | 10/1985 | Kobayashi et al. . | |
| 4,572,393 | 2/1986 | Kobayashi et al. . | |
| 4,767,020 | 8/1988 | Peter et al. . | |
| 4,804,106 | 2/1989 | Saunders . | |
| 5,232,114 | 8/1993 | Zysset . | |

*Primary Examiner*—Stephen K. Cronin
*Assistant Examiner*—Nathan Newhouse
*Attorney, Agent, or Firm*—David W. Brownlee; Edward L. Levine

[57] ABSTRACT

A convenience easy opening end having a removable panel portion which includes a narrow U-shaped stem portion extending from a larger rounded bulbous portion and with a pull tab attached to the stem portion.

11 Claims, 4 Drawing Sheets

CONVENIENCE EASY OPENING END WITH LARGE REMOVAL PANEL

FIELD OF THE INVENTION

This invention relates broadly to the field of convenience closures or can ends. More specifically, this invention relates to an improved easy opening convenience closure for pressurized containers. The closure has a score line configuration that controls propagation of rupture of the score from the force of compressed air or gases in the container on which the closure is affixed.

BACKGROUND OF THE INVENTION

Convenience closures or can lids for containers of juices and certain other products may have full panel pull out portions in the lids. A score line in the lid defines a relatively large removable panel portion to permit removal of the contents from the container. Some such juices and other products are packed under pressure, and it may be desirable to package additional products under pressure, especially in thin wall drawn and ironed aluminum cans. When convenience containers are packed under pressure, the pressure is released when rupture of the score line in the easy opening end is initiated by lifting a pull tab which is attached to the can end or closure. The force of the pressure against the product side of the closure may cause uncontrolled propagation of rupture of the score line. Such uncontrolled propagation of the score rupture is undesirable.

It is well known to provide a vent release for full panel pull out convenience closures to relieve the internal pressure in the container before initiation of rupture of the score line around the removable panel portion. Such vent releases are disclosed in U.S. Pat. No. 3,724,709 to Westphal and U.S. Pat. No. 4,043,479 to Khoury, among others. However, such vent releases are not foolproof in that the vent does not always open before initiation of rupture of the primary score.

An improved large panel pullout convenience closure for pressurized containers is needed which is virtually foolproof against uncontrolled rupture of the score line around the removable panel.

SUMMARY OF THE INVENTION

An improved large panel convenience closure is provided that has a score line configuration which resists uncontrolled propagation of score line rupture when the pull tab is lifted. The score line in a closure of this invention defines a large removable panel including a bulbous, generally elliptical portion and a narrow U-shaped stem portion. There is a rounded transition in the score line between the stem portion and the bulbous portion on both sides of the removable panel portion. A pull tab is attached to the stem portion to facilitate rupture of the score line and to remove the large panel pullout from the closure. When the pull tab is lifted to initiate rupture, the score line ruptures around the end of the stem portion and at least part way along both sides of the stem. Rupture of the score line does not propagate into the bulbous portion of the panel when the tab is first lifted. This is because transition from the narrow stem to the larger bulbous portion resists propagation of the rupture of the score line around the bulbous portion. The transition between the stem and bulbous portions acts like a stop or brake on rupture of the score line.

The transition in the score line has a radius of appropriate small size such as about ⅛ to ½ inches, and preferably about ½ inch so it will stop uncontrolled propagation of the score line, but is not so small as to make intentional tearing of the score line difficult.

It is therefore seen that an object of this invention is to provide an improved convenience closure for pressurized cans which includes a score configuration that resists uncontrolled rupture of the score line while permitting intentional rupture of the score line with reasonable force.

BRIEF DESCRIPTION OF THE DRAWINGS

The above and other objects and advantages of the invention will become apparent from the following specification and accompanying drawings in which.

DESCRIPTION OF PREFERRED EMBODIMENTS OF THE INVENTION

Figure 1:
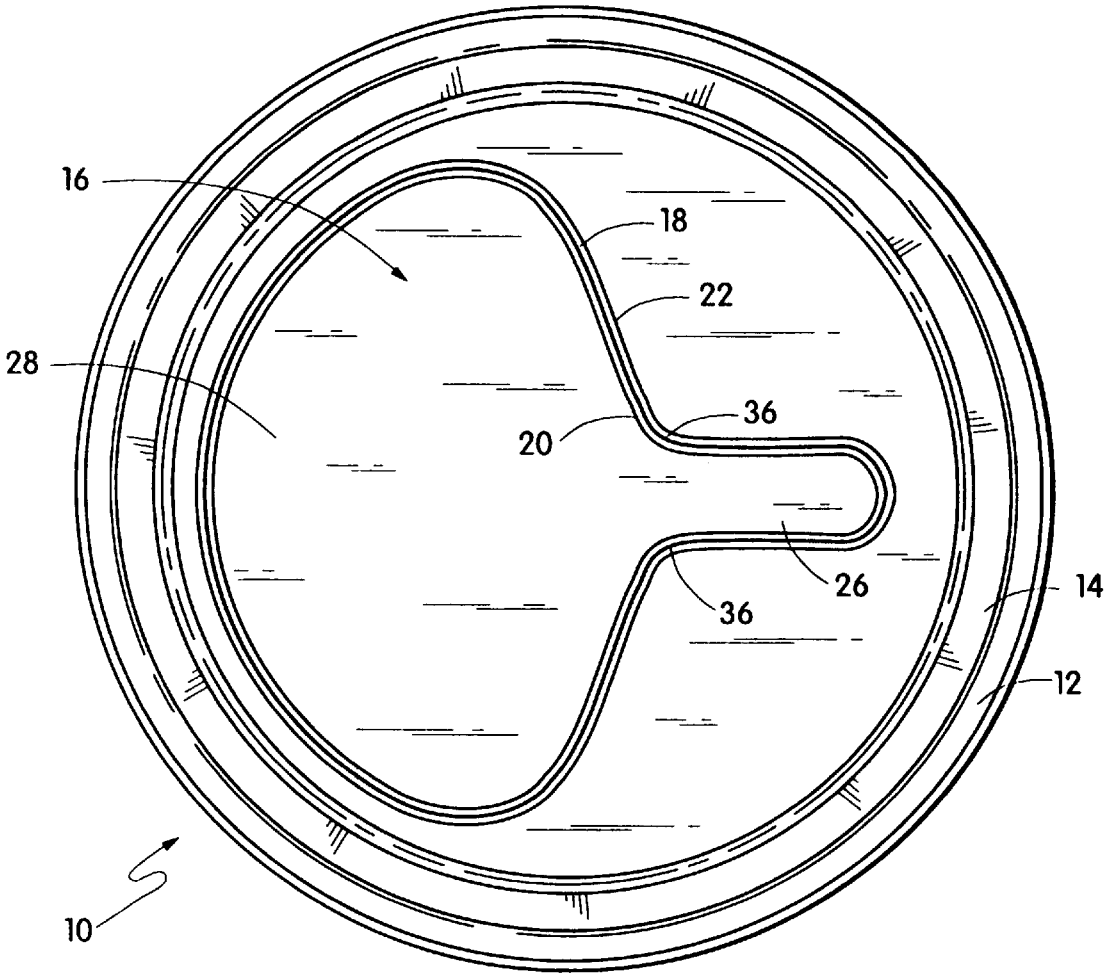
FIG. 1 is a top plan view of a convenience closure of this invention without a pull tab.
Figure 3:
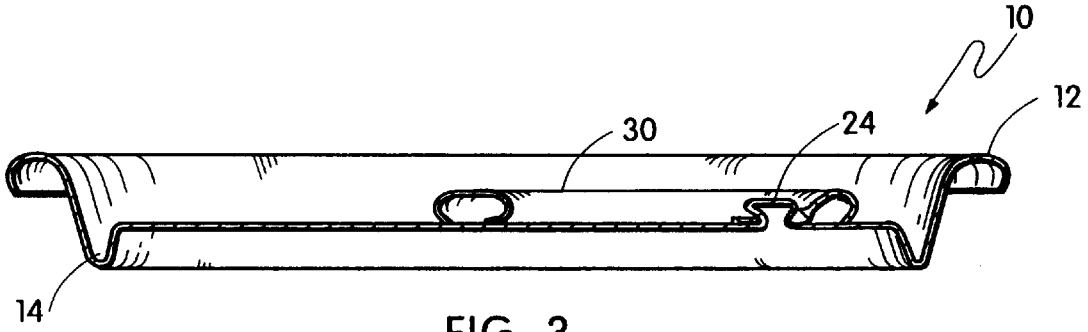
FIG. 3 is a cross section through the closure of FIG. 2.
Figure 2:
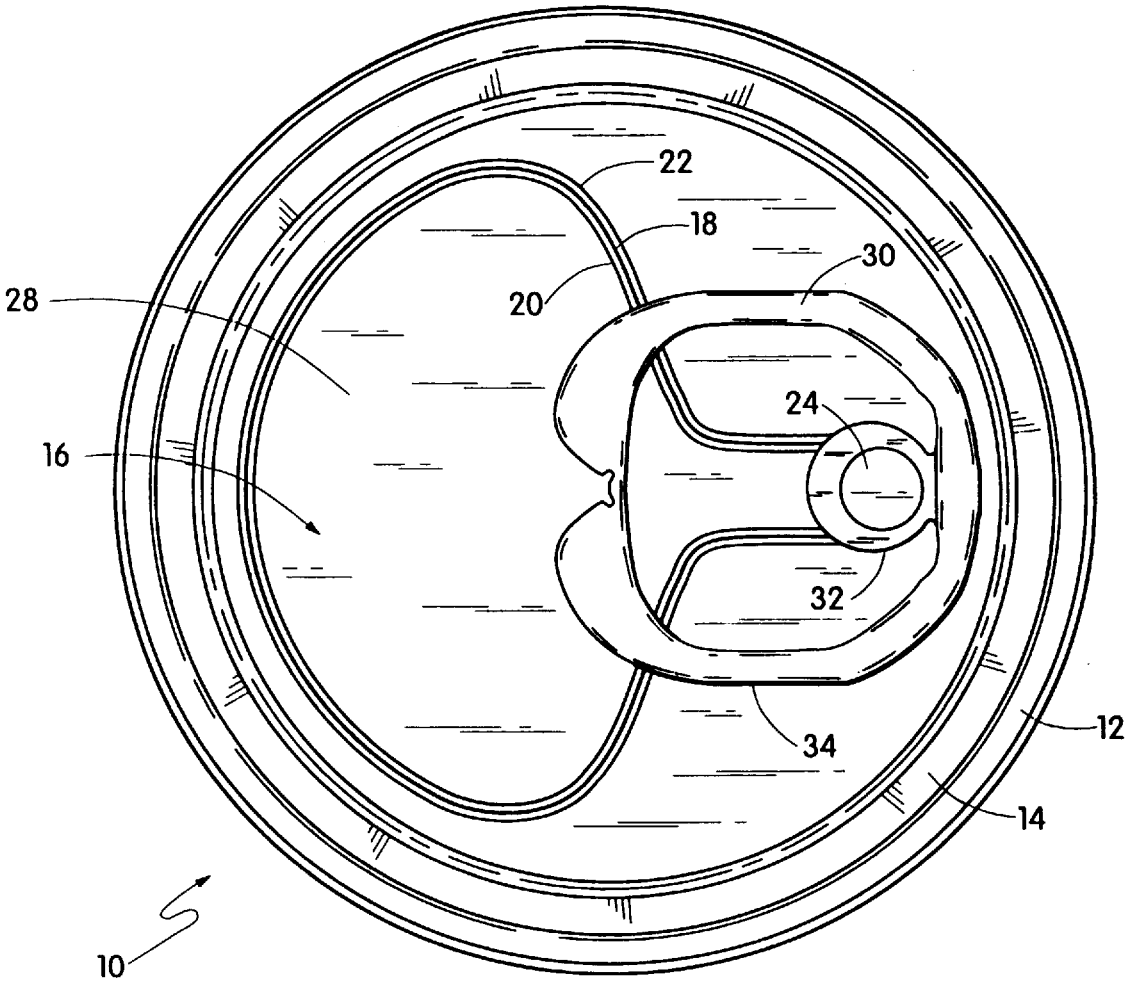
FIG. 2 is a top plan view similar to FIG. 1 and further showing a pull tab attached to the removable panel portion of the closure.

Referring to FIGS. 1, 2 and 3, a preferred embodiment of a convenience closure 10 of this invention is shown. The closure is preferably made from a hard temper aluminum alloy such as 5182-H19 alloy as registered by the Aluminum Association. The closure is preferably made from aluminum sheet material which is about 0.007 to 0.014 inch thick. The closure 10 has a peripheral flange 12 for securing the closure on a can body by conventional double seaming and may optionally include a conventional countersink channel 14 adjacent the flange 12. The closure further has a relatively large removable panel portion 16 defined by a score line 18. The panel portion 16 includes a generally U-shaped stem portion 26 and a larger bulbous portion 28, which may be generally elliptical or circular in shape.

The closure 10 may optionally include anti-fracture scores 20 and 22 along opposite sides of the primary score line 18. Anti-fracture score lines are well known in the art as disclosed by U.S. Pat. No. 3,954,075, among others. The primary score line 18 may be the same depth all the way around the removable panel 16, but may optionally have different depths in selected locations to act as speed checks during the rupture of the score line as is described below.

The closure 10 has an integral rivet 24 in the end of the stem portion 26 for attachment of a pull tab 30 (FIGS. 2 and 3). The tab may be of a variety of configurations well known in the art such as the tabs shown in U.S. Patents Re. 31,702, 3,870,001 and 4,024,981 among others. The tab 30 which has been selected for illustration in the optional embodiment of FIGS. 2–5 includes an attachment portion 32 and a ring shaped handle portion 34 for the user to grip to rupture the score line 18. The tab 30 is preferably made from a hard temper aluminum alloy such as H-19 5042. U.S. Pat. No. 3,880,318 illustrates and describes such a tab and its manufacture.

It is a feature of this invention that the removable panel portion 16 includes a rounded bulbous portion 28 and a narrow stem portion 26 extending from the bulbous portion. The score line 18 at the juncture of the bulbous portion and the stem portion comprises a transitional radius 36 on both sides of the removable panel. The radius of the curvature at radii 36 is preferably relatively small in a range of about ⅛ to ½ inch or larger and more preferably about ¼ inch to act as a brake or stop against uncontrolled propagation of rupture of the score line 18 at the radius. The scoreline preferably diverges outwardly at an angle of about 100°–130°, and more preferably 110°–120° at the transition between the stem portion and the bulbous body portion of the removable panel.

The stem portion 26 of the removable panel 16 may have a length of about ¼ inch to ½ inch or more from the center of the rivet 24 to the start of radii 36. The optimum length depends on the diameter of the closure 10, the type of tab that is used, the pressure in the can to be closed and the score depth among other factors. A longer stem 26 will provide greater insurance against uncontrolled rupture of the score line 16, but limits the area available for, and the size of, the bulbous portion 28 of the opening panel. Accordingly, the length of stem portion 26 must be balanced against the size of the bulbous portion 28 to optimize opening characteristics and the size of opening in the closure. The score line 18 along opposite sides of the stem portion 26 are preferably parallel but may diverge or converge slightly toward the bulbous portion 28. Preferably the removable panel 16 encompasses an area of at least about 40% of the lid.

As stated above, the depth of the score line 18 may be varied in order to provide greater resistance to uncontrolled rupture of the score line. For example, the score may have a first depth around the rivet end of the stem portion 26 and a progressively shallower depth toward the radius 36 at the juncture between the two portions and then again taper or step down to the first depth at or adjacent the radius 36. The change in score depth can be produced either by the rib in the scoring tool having different heights or by the supporting anvil having lowered or raised portions to produce a deeper or shallower score line at selected locations.

Figure 4:
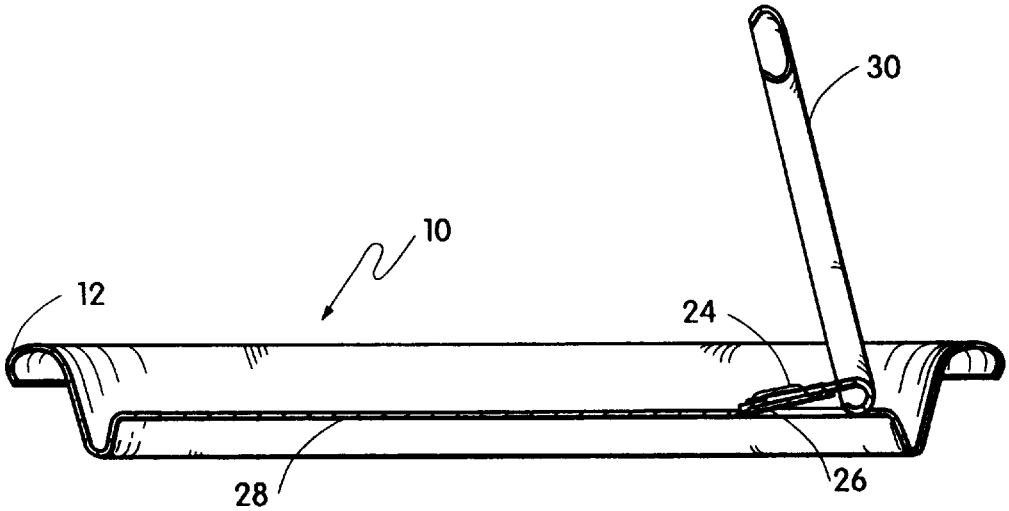
FIG. 4 is a cross section similar to FIG. 3 and further showing the handle end of the pull tab lifted to initiate rupture of the score line around the removable panel portion.
Figure 5:
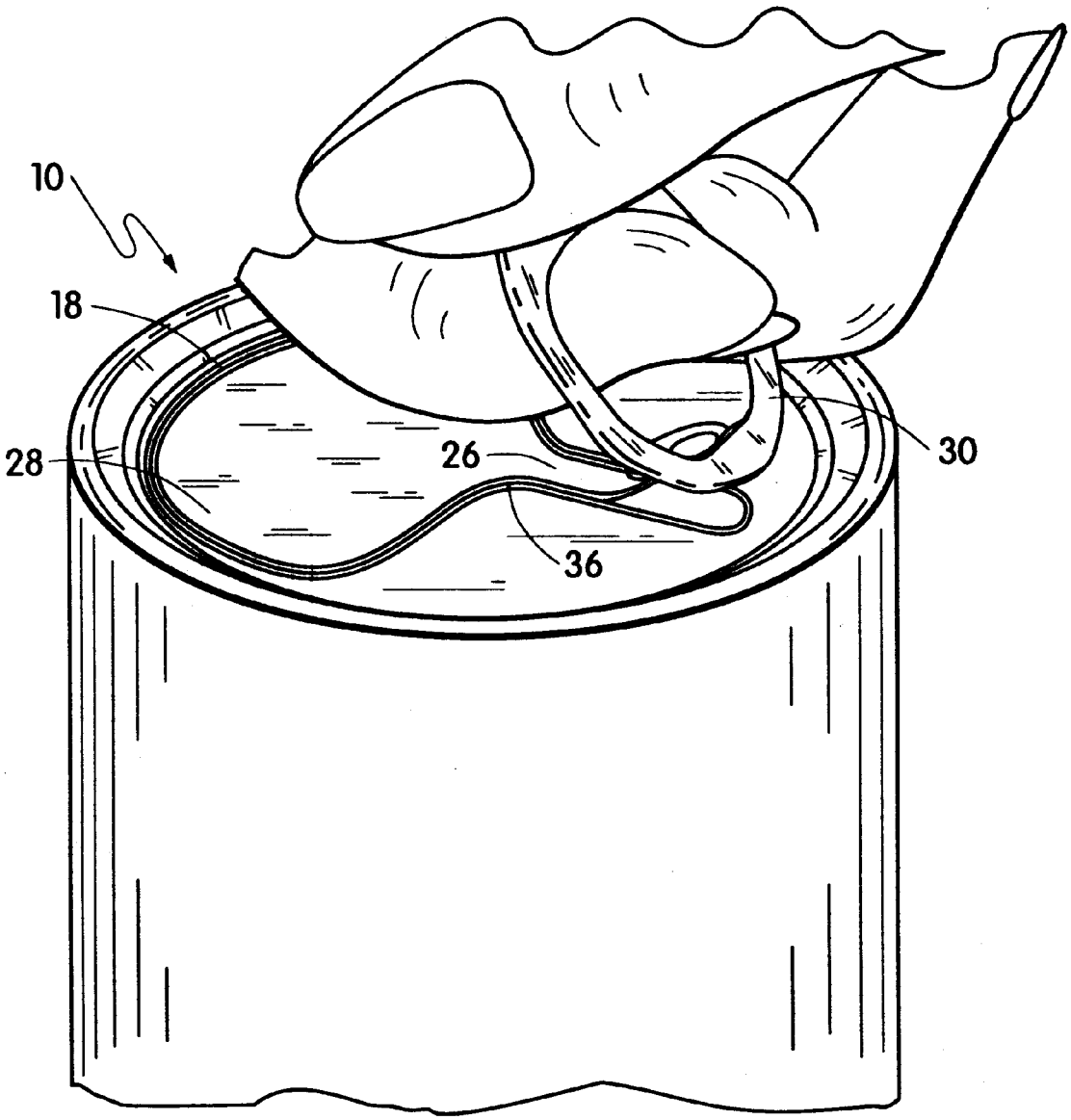
FIG. 5 is a perspective of the convenience closure of FIG. 4.
Figure 6:
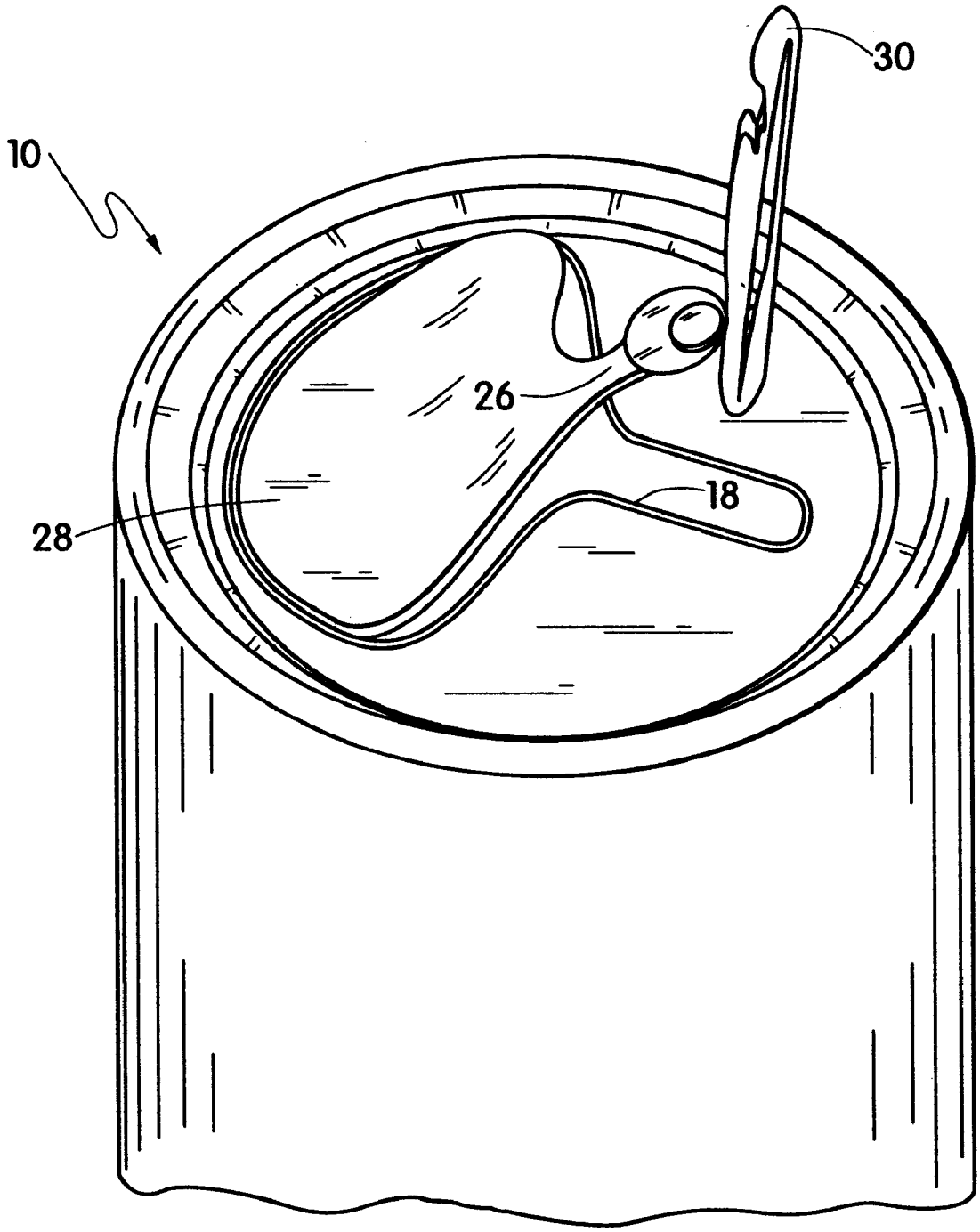
FIG. 6 is a perspective view of the closure of FIGS. 1–4 secured on a can body and further showing partial removal of the panel portion from the closure.

FIGS. 4 and 5 show initiation of rupture of score line 18. This has been done by lifting the handle end of the pull tab 30 as is conventional for easy opening ends. The tab 30 has a handle end and a nose end. The nose end overlies and is attached to the stem portion 26 of the removable panel and the handle end overlies the body portion 28 of the removable panel. Lifting the tab 30 ruptures the score line 18 around the rivet end of the stem portion 26 of the removable panel by the lever action of the tab as well known in the art. As shown in these figures, the score line 18 has ruptured only along opposite sides of the stem portion 26 and is not ruptured in the radii 36 or around the bulbous portion 28. After initiation of rupture of the score line 18 around the rivet end of the stem portion 26, the pull tab 30 is pulled to continue to rupture the score line around the remainder of the removable panel 28 is as shown in FIG. 6. In the preferred embodiment of this invention, the removable panel 28 is completely separated from the closure.

As explained above, it is a feature of this invention that the configuration of the score line 18 resists uncontrolled rupture of the score line when the pull tab is first lifted. The transition between the narrow stem 26 and the larger bulbous portion 28 of the removable panel acts as a brake to stop uncontrolled rupture of the score as might otherwise result from the release of the internal pressure in the can. An assist to the braking action may also be provided by the increased score residual proceeding along the stem toward the bulbous portion. The increased score residual is nominally about 0.0005 to 0.001 inch greater than the score residual around the remainder of the removal panel to produce the desired braking action against uncontrolled rupture without significantly affecting continued intentional rupture of the score line by pulling on the pull tab 30.

It is therefore seen that this invention provides an improved convenience closure which provides assurance against uncontrolled rupture of the score line around the removable panel. While a preferred embodiment of the invention has been illustrated and described, it will be apparent that various changes may be made without deviating from the inventive concept and the scope of the claims appended hereto:

What is claimed is:

1. In a sheet metal easy opening lid for a container which has a score line defining a removal panel comprising at least about 40% of said lid for providing access to the inside of the container and a pull tab attached to the removable panel, the improvement comprising said score line defining a rounded bulbous body portion and a narrow U-shaped stem portion extending from and integrally connected to said body portion through a transition portion comprising a rounded shoulder having a radius of about ⅛ to ½ inch on both sides of said removable panel, said tab attached to said stem portion to initiate rupture of said score line around said removable panel, and said score line having less score depth on both sides of said narrow U-shaped stem portion than it has around the attachment of said tab to said stem portion.

2. An easy opening lid as set forth in claim 1 in which said score line has a radius of about ¼ inch at said rounded shoulder on both sides of said removable panel.

3. An easy opening lid as set forth in claim 1 which has a central panel portion with a peripheral flange around it and in which said removable panel comprises at least about 40% of said central panel portion of the lid.

4. An easy opening lid as set forth in claim 1 in which said tab has a handle end and a nose end, said nose end overlies and is attached to said stem portion of said removable panel portion and said handle end overlies said body portion of said removable panel portion.

5. An easy opening lid as set forth in claim 1 in which the segments of said score line along the sides of said stem are substantially parallel and the score line diverges outwardly at an angle of about 100–130° to said substantially parallel segments at the transition between said stem portion and said body portion of said removable panel.

6. An easy opening lid as set forth in claim 5 in which said angle is about 110–120°.

7. An easy opening lid as set forth in claim 1 which is made from aluminum rigid container sheet.

8. An easy opening end as set forth in claim 1 in which an integral rivet on said lid joins said pull tab to said lid.

9. An easy opening device for a pressurized container which comprises:

a sheet metal lid having a central portion and a peripheral flange for attaching the lid to a container body;

said lid having a score line in it defining a removable panel portion which comprises at least about 40% of said central portion and a pull tab attached to said removable panel portion by an integral rivet on said removable panel portion;

said removable panel portion having a bulbous configuration with a relatively large rounded body portion, a narrow U-shaped tearstrip projecting from said body portion and a rounded corner having a radius of less than about ½ inch between said body portion and said tearstrip on both sides of said tearstrip, said pull tab attached to said tearstrip so that lifting of said tab will initiate rupture of said score line around said tearstrip and propagation of rupture of said score line around said body portion of said removable panel portion is resisted by said rounded corner between said tearstrip and said body portion, and said score line having less score depth on both sides of said narrow U-shaped tearstrip than it has around the attachment of said tab to said tearstrip.

10. An easy opening device as set forth in claim 9 in which said U-shaped tearstrip has parallel sides and said score line diverges outwardly from said parallel sides at an angle of about 100–130° at the transition between said tearstrip and said body portion.

11. An easy opening device as set forth in claim 9 in which said score depth on both sides of said narrow tearstrip is less than the score depth around said relatively large rounded body portion of said removable panel.

* * * * *